US010876298B2

(12) United States Patent
Sawada

(10) Patent No.: US 10,876,298 B2
(45) Date of Patent: Dec. 29, 2020

(54) WALL-MATERIAL MOUNTING MEMBER AND WALL STRUCTURE

(71) Applicant: NICHIHA CORPORATION, Nagoya (JP)

(72) Inventor: Youhei Sawada, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 0 days.

(21) Appl. No.: 16/487,255

(22) PCT Filed: Mar. 7, 2018

(86) PCT No.: PCT/JP2018/008767

§ 371 (c)(1),
(2) Date: Aug. 20, 2019

(87) PCT Pub. No.: WO2018/164183

PCT Pub. Date: Sep. 13, 2018

(65) Prior Publication Data

US 2020/0018075 A1 Jan. 16, 2020

(30) Foreign Application Priority Data

Mar. 9, 2017 (JP) ..... 2017-044666

(51) Int. Cl.
*E04B 2/00* (2006.01)
*E04F 13/08* (2006.01)
(Continued)

(52) U.S. Cl.
CPC ..... *E04F 13/081* (2013.01); *E04B 1/40* (2013.01); *E04B 2001/405* (2013.01)

(58) Field of Classification Search
None
See application file for complete search history.

(56) References Cited

U.S. PATENT DOCUMENTS 4,899,508 A * 2/1990 Biebuyck ..... E04B 2/962 52/235
5,634,305 A * 6/1997 Erlanger ..... E04B 2/86 52/235
(Continued)

FOREIGN PATENT DOCUMENTS

EP 0329060 A2 8/1989
EP 0659954 A1 6/1995
(Continued)

OTHER PUBLICATIONS

International Search Report (PCT/ISA/210) issued in PCT/JP2018/008767, dated May 29, 2018.
(Continued)

*Primary Examiner* — Basil S Katcheves
(74) *Attorney, Agent, or Firm* — Birch, Stewart, Kolasch & Birch, LLP

(57) ABSTRACT

Provided are a wall-material mounting member and a wall structure that make it possible to reduce the gap between the lower end of a window frame or the like and an end portion of a wall material, while also facilitating the mounting operation, thus enhancing the appearance quality of an installed wall. A fixed member 110 includes guiding portions 111L and 111R that movably guide movable main bodies 125L and 125R of a movable member 120 in a first direction, and pressing portions 113L and 113R that press the movable main bodies 125L and 125R toward the guiding portions 111L and 111R. The movable member 120 includes a protruding piece 121 protruding from the movable main bodies 125L and 125R in a second direction, and a locking piece 123 protruding from the protruding piece 121 in the first direction. The protruding piece 121 is provided with a first tool engagement portion 121U capable of taking on a force F1 in the first direction. The locking piece 123 is provided with a second tool engagement portion 123H
(Continued)

capable of taking on the force F1 in the first direction at a position that is displaced relative to the first tool engagement portion 121U in the first direction.

13 Claims, 12 Drawing Sheets

(51) Int. Cl.
*E04B 1/41* (2006.01)
*E04B 1/38* (2006.01)

(56) References Cited

U.S. PATENT DOCUMENTS

| | | | | |
|---|---|---|---|---|
| 7,665,253 | B1 * | 2/2010 | Thompson | E04B 1/2604 52/153 |
| 8,973,330 | B2 * | 3/2015 | Egri, II | E04F 13/0805 248/231.81 |
| 9,416,529 | B1 * | 8/2016 | Jeske | E04B 1/41 |
| 2003/0188497 | A1 * | 10/2003 | Price | E02D 27/01 52/169.12 |
| 2007/0261347 | A1 * | 11/2007 | Launs | E04B 9/06 52/506.05 |

FOREIGN PATENT DOCUMENTS

| | | | |
|---|---|---|---|
| GB | 2 352 255 | A | 1/2001 |
| GB | 2384501 | A | 7/2003 |
| JP | 64-14834 | U | 1/1989 |
| JP | 2-115444 | A | 4/1990 |
| JP | 4-92934 | U | 8/1992 |
| JP | 4-49311 | Y2 | 11/1992 |
| JP | 5-10013 | A | 1/1993 |
| JP | 6-27706 | Y2 | 7/1994 |
| JP | 2000-96804 | A | 4/2000 |
| JP | 2000-336894 | A | 12/2000 |
| JP | 2003-166325 | A | 6/2003 |
| JP | 2003-239495 | A | 8/2003 |
| JP | 2005-60954 | A | 3/2005 |
| JP | 2005-336782 | A | 12/2005 |
| JP | 2006-45900 | A | 2/2006 |
| JP | 2007-217972 | A | 8/2007 |
| JP | 2008-31717 | A | 2/2008 |
| JP | 2008-163699 | A | 7/2008 |
| JP | 2010-7446 | A | 1/2010 |
| JP | 2010-121387 | A | 6/2010 |
| JP | 2010-222791 | A | 10/2010 |
| JP | 2012-62635 | A | 3/2012 |
| JP | 2013-119720 | A | 6/2013 |
| JP | 2015-108239 | A | 6/2015 |
| JP | 2016-98615 | A | 5/2016 |
| WO | WO 2004/046487 | A2 | 6/2004 |

OTHER PUBLICATIONS

Extended European Search Report, dated Sep. 11. 2020, for European Application No. 18763554.5.

* cited by examiner

WALL-MATERIAL MOUNTING MEMBER AND WALL STRUCTURE

TECHNICAL FIELD

The present invention relates to a wall-material mounting member and a wall structure.

BACKGROUND ART

As mounting members for mounting a wall material to a structural body, those disclosed in Patent Documents 1 to 3 have been conventionally available.

The mounting member disclosed in Patent Document 1 includes a fixing fitting and an engaging fitting. The fixing fitting is disposed below a window frame or the like, and is mounted in advance to a structural body by fixing its main body fixing portion to the structural body. The engaging fitting is mounted in advance to a wall material through engagement between the engagement portion with an end portion of the wall material. The mounting member is configured such that the engaging fitting is mounted, together with the wall material, to the fixing fitting on the structural body side as a result of the engaging fitting engaging with the fixing fitting.

The mounting member disclosed in Patent Document 2 includes a mounting fitting main body and a movable member. The movable member is capable of locking an end portion of a wall material by using its engagement portion. In addition, the movable member is capable of moving relative to the mounting fitting main body within a range in which a fixing male screw moves in an elongated hole of the mounting fitting main body. The mounting member is configured such that the mounting fitting main body and the movable member are mounted to the wall material by fastening the fixing male screw in a state where the end portion of the wall material is locked by the engagement portion of the movable member.

The mounting member disclosed in Patent Document 3 includes a fixation fitting and an engagement fitting. The fixation fitting is disposed below a window frame or the like, and is mounted in advance to a structural body by fixing a fixation portion to the structural body. The engagement fitting is capable of locking an end portion of the wall material. In addition, the engagement fitting is held so as to be able to move relative to the fixation fitting while being shallowly inserted into the fixation fitting. Then, pressing down on the engagement fitting causes the engagement fitting to be deeply inserted into the fixation fitting, thus locking the end portion of the wall material, and causing the engagement fitting to be fixed to the fixation fitting.

CITATION LIST

Patent Documents

Patent Document 1: JP 2007-217972A
Patent Document 2: JP 2010-121387A
Patent Document 3: JP 2010-7446A

SUMMARY OF INVENTION

Technical Problem

In the case of the mounting member disclosed in Patent Document 1, it is difficult to engage the engaging fitting located on the back surface side of the wall material with the fixing fitting on the structural body side when mounting the engaging fitting to the fixing fitting together with the wall material. Consequently, it is likely that it is difficult to reduce the gap between the lower end of a window frame or the like and an end portion of the wall material, resulting in the possibility that the appearance of an installed wall may be impaired.

In the case of the mounting member disclosed in Patent Document 2, the movable member needs to be fixed using a fixing male screw, and installation is likely to be troublesome.

In the case of the mounting member disclosed in Patent Document 3, a gap for pressing down the engagement fitting needs to be secured between the lower end of a window frame or the like and the engagement fitting. Accordingly, reducing this gap makes it difficult to perform an operation, and installation is likely to be troublesome.

That is, with the above-described conventional mounting members, it is difficult to reduce the gap between the lower end of a window frame or the like and an end portion of the wall material, while also facilitating the mounting operation.

The present invention has been made in view of the above-described conventional circumstances, and it is an object of the invention to provide a wall-material mounting member and a wall structure that make it possible to reduce the gap between the lower end of a window frame or the like and an end portion of a wall material, while also facilitating the mounting operation, thus enhancing the appearance quality of an installed wall.

Solution to Problem

A wall-material mounting member according to a first aspect of the present invention is a wall-material mounting member for mounting a wall material to a structural body, and is characterized by including:

a fixed member including a base portion that can be fixed to the structural body; and a movable member including a movable main body that is movably supported by the fixed member, wherein the fixed member includes a guiding portion that movably guides the movable main body in a first direction, and a pressing portion that presses the movable main body toward the guiding portion, the movable member includes a protruding piece protruding from the movable main body in a second direction that intersects the first direction, and a locking piece protruding from the protruding piece in the first direction, the protruding piece is provided with a first tool engagement portion capable of taking on a force in the first direction, and the locking piece is provided with a second tool engagement portion capable of taking on a force in the first direction at a position that is displaced relative to the first tool engagement portion in the first direction.

With the wall-material mounting member according to the first aspect, in a state in which the locking piece is yet to lock an end portion of the wall material, the protruding piece of the movable member can be disposed sufficiently close to the lower end of a window frame or the like to such a degree that the protruding piece is substantially in contact with the lower end of the window frame or the like. That is, the mounting member can be disposed in a state in which the gap between the lower end of a window frame or the like and the end portion of the wall material is reduced to be about the length of the locking piece in the first direction.

Then, a tool such as a flathead screwdriver is engaged with the second tool engagement portion, and a force in the first direction is exerted so as to move the movable member in the first direction. As a result, the locking piece starts locking the end portion of the wall material, and a gap is secured between the lower end of the window frame or the like and the protruding piece of the movable member. Through this gap, a tool such as a flathead screwdriver is engaged with the first tool engagement portion, and a force in the first direction is exerted so as to further move the movable member in the first direction. As a result, the locking piece completely locks the end portion of the wall material.

That is, with this mounting member, the locking piece is moved in a plurality of steps. Accordingly, there is no need to secure a gap for inserting a tool or the like between the lower end of the window frame or the like and the protruding piece of the movable member in a state in which the movable member is at its position where the locking piece is yet to lock the end portion of the wall material.

Therefore, with the wall-material mounting member according to the first aspect of the present invention, it is possible to reduce the gap between the lower end of a window frame or the like and an end portion of the wall material, while also facilitating the mounting operation, thus making it possible to enhance the appearance quality of an installed wall.

As a second aspect of the present invention, it is preferable that the first tool engagement portion is formed by a surface of the protruding piece that faces in a direction opposite to the first direction.

In this case, it is easy to provide the protruding piece with the first tool engagement portion.

As a third aspect of the present invention, it is preferable that the second tool engagement portion is a hole extending through the locking piece in the second direction.

In this case, it is easy to provide the locking piece with the second tool engagement portion without it being bulky. In addition, a tool such as a flathead screwdriver can be reliably engaged with the second tool engagement portion. As a result, it is possible to make the mounting member more compact, and further facilitate the mounting operation.

As a fourth aspect of the present invention, it is preferable that the fixed member includes a restricting portion. Preferably, the movable member includes a restricted portion. Also, it is preferable that the restricting portion is configured to abut against the restricted portion of the movable member moving in a direction opposite to the first direction so as to restrict a moving range of the movable member.

In this case, the moving range of the movable member relative to the fixed member can be kept constant by the restricting portion and the restricted portion in a state in which the movable member is at its position where the locking piece is yet to lock the end portion of the wall material. As a result, it is possible to further facilitate the mounting operation, and enhance the appearance quality of a mounted wall.

As a fifth aspect of the present invention, it is preferable that the restricting portion is a recess that is provided in the guiding portion or the pressing portion, and that extends in the first direction. Also, it is preferable that the restricted portion is a protrusion that is provided protruding from the movable main body, and that is located inside the recess.

In this case, it is easy to form the restricting portion and the restricted portion.

As a sixth aspect of the present invention, it is preferable that the guiding portion or the pressing portion includes a linear projection portion extending in the first direction. Preferably, the recess is formed by a groove portion formed along a back surface of the linear projection portion that opposes the movable main body. Also, it is preferable that the protrusion is located inside the groove portion.

In this case, the groove portion on the back surface of the linear projection portion is used as the recess, and, thus, the fixed member can be made more compact. Since the linear projection portion also functions as a rib for reinforcing the guiding portion or the pressing portion, the guiding portion and the pressing portion can suitably guide the movable member. The linear projection portion is used as the support surface, and the wall material can be supported by the support surface abutting against the back surface of the wall material. In this case, when mounting the wall material, the wall material can be guided using the support surface such that the end portion of the wall material approaches the locking piece.

As a seventh aspect of the present invention, it is preferable that the movable main body includes a marker portion that is covered by the fixed member in a state in which the locking piece is at one of a close position at which the locking piece is closest to the fixed member and a spaced position at which the locking piece is spaced farthest apart from the fixed member, and that is exposed from the fixed member in a state in which the locking piece is at the other of the close position and the spaced position.

In this case, the marker portion enables easy visual confirmation of the position of the locking piece. As a result, it is possible to further facilitate the mounting operation.

As an eighth aspect of the present invention, it is preferable that the movable main body includes a first surface facing in the second direction, and a second surface facing in a direction opposite to the second direction. Preferably, the guiding portion includes a guiding surface that comes into surface contact with one of the first surface and the second surface. Preferably, the pressing portion includes a pressing surface that comes into surface contact with the other of the first surface and the second surface. Also, it is preferable that the movable member is sandwiched by the guiding surface and the pressing surface.

In this case, with a configuration in which the movable main body is movably supported by the fixed member through frictional engagement due to surface contact, the mounting member can be simplified. Using frictional engagement, the movable main body can be easily moved by engaging a tool with the first tool engagement portion and the second tool engagement portion. As a result, it is possible to further facilitate the mounting operation.

As a ninth aspect of the present invention, it is preferable that the guiding surface is one surface of a plate-shaped piece extending from the base portion. Also, it is preferable that the pressing surface is one surface of a small piece extending from the base portion, and opposes the guiding portion.

In this case, by bending, or cutting and bending a plate material, the guiding surface and the pressing surface can be made into one piece, and the magnitude of the sliding resistance generated by frictional engagement can also be easily adjusted.

A tenth aspect of the present invention, it is preferable that a pair of the guiding portions are provided at positions sandwiching the base portion. Preferably, the movable main body includes a pair of leg portions respectively disposed in the pair of the guiding portions. Preferably, the protruding piece and the locking piece are provided spanning the pair of the leg portions. Also, it is preferable that, when the movable member is viewed in the second direction, the second tool engagement portion is provided in the locking piece between one of the leg portions and the other leg portion.

In this case, it is possible, with a simple configuration, to keep the movable member from being inclined relative to the guiding portion when moving the movable member, and prevent the movable member from catching on the guiding portion while moving. As a result, it is possible to further facilitate the mounting operation.

A wall structure according to an eleventh aspect of the present invention is a wall structure in which a wall material is mounted to a structural body of a building by using a mounting member, and is characterized in that the mounting member includes:

a fixed member including a base portion that can be fixed to the structural body; and a movable member including a movable main body that is movably supported by the fixed member, the fixed member includes a guiding portion that movably guides the movable main body in a first direction, and a pressing portion that presses the movable main body toward the guiding portion, the movable member includes a protruding piece protruding from the movable main body in a second direction that intersects the first direction, and a locking piece protruding from the protruding piece in the first direction, and capable of locking an end portion of the wall material, the protruding piece is provided with a first tool engagement portion capable of taking on a force in the first direction, and the locking piece is provided with a second tool engagement portion capable of taking on a force in the first direction at a position that is displaced relative to the first tool engagement portion in the first direction.

With the wall structure according to the eleventh aspect of the present invention, the operation and the effect achieved by the mounting member according to the first aspect make it possible to reduce the gap between the lower end of a window frame or the like and an end portion of the wall material, while also facilitating the mounting operation. Therefore, it is possible to provide a wall structure with high appearance quality.

Advantageous Effects of Invention

With the wall-material mounting member and the wall structure according to the present invention, it is possible to reduce the gap between the lower end of a window frame or the like and an end portion of a wall material, while also facilitating the mounting operation. This makes it possible to enhance the appearance quality of an installed wall.

DESCRIPTION OF EMBODIMENTS

Figure 1:
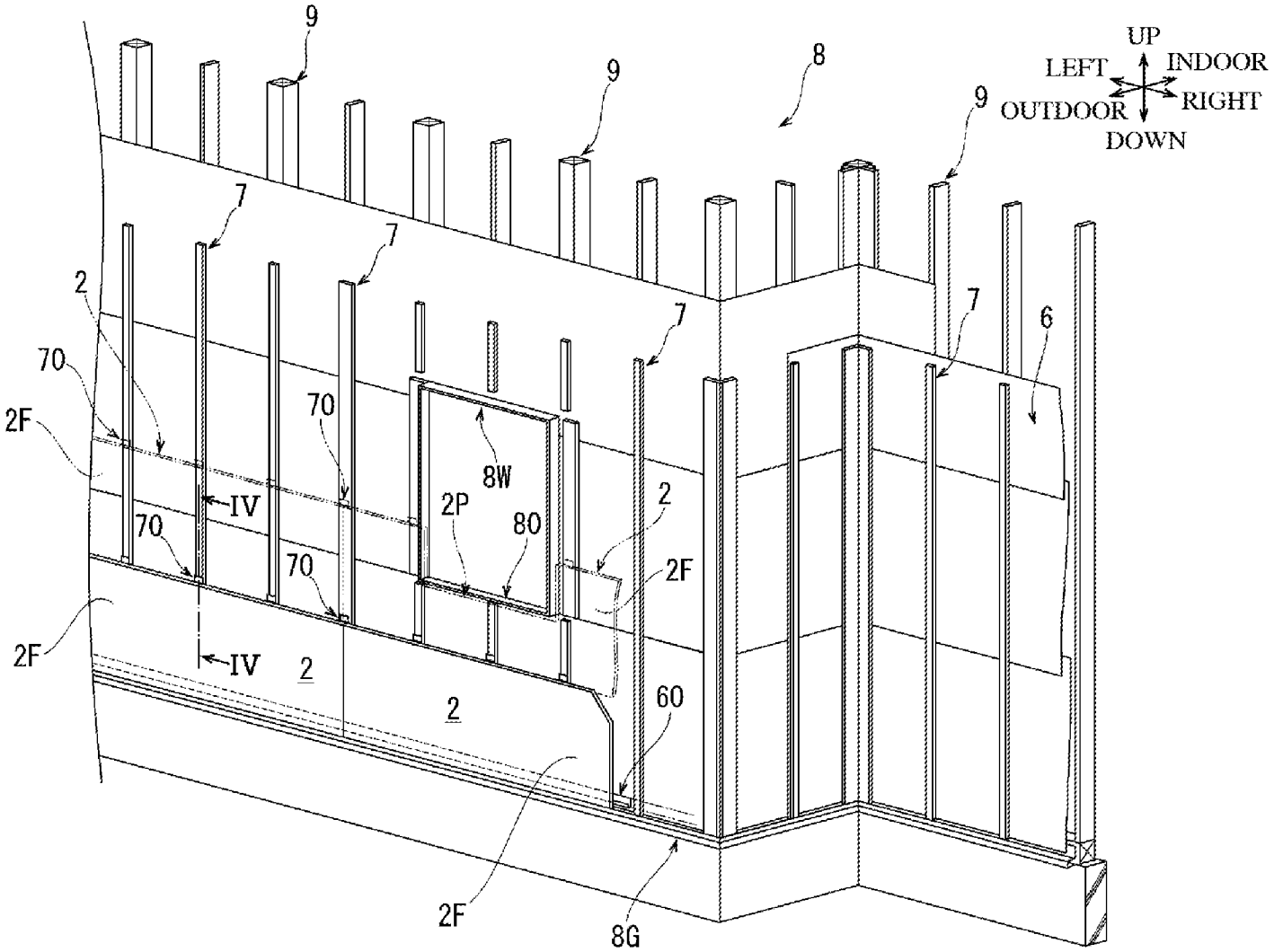
FIG. 1 is a perspective view of a wall structure according to Embodiment 1.

In the following, Embodiments 1 and 2 of the present invention will be described with reference to the drawings. Note that, in FIG. 1, a vertically upward direction is indicated as "up", and a vertically downward direction is indicated as "down". In addition, a horizontally leftward direction in a direction from the outdoor side to the indoor side in FIG. 1 is indicated as "left", and a horizontally rightward direction is indicated as "right". The directions shown in FIG. 2 and subsequent drawings are indicated so as to correspond to FIG. 1.

Embodiment 1

As shown in FIG. 1, a wall structure according to Embodiment 1 is an example of a specific embodiment of a wall structure. This wall structure is formed by mounting a plurality of exterior wall plates 2 shown in FIGS. 2, 3, and so forth to a structural body 8 that forms a building such as a residence, a facility, or a warehouse. Each exterior wall plate 2 is an example of the wall material. The exterior wall plate 2 is a plate material that itself has high strength and high rigidity, and forms an exterior wall of the building. Note that the wall material is not limited to an exterior wall plate, and may be, for example, a decorative plate for decorating the outside of the building, an indoor structural panel, an interior plate, or the like.

As shown in FIG. 1, the structural body 8 is constructed, for example, by wood post and beam construction. The structural body 8 is made up of a plurality of structural members. The structural members include a plurality of column materials arranged in a horizontal direction at predetermined intervals, and column members 9 such as studs disposed between the column materials. A support member 7 called a furring strip is fixed to the outer surface of each column member 9 that faces in the outdoor direction, using a set screw, a nail, or the like (not shown). The support member 7 is also included in the structural members. In addition, a waterproof sheet 6 is laid between the support members 7 and the column members 9. Note that the structural body 8 is not limited to the configuration of the present embodiment, and may be constructed through timber frame construction or the like. The structural body that forms the wall structure may be of, for example, steel construction, reinforced concrete construction, brick construction, or the like.

Figure 2:
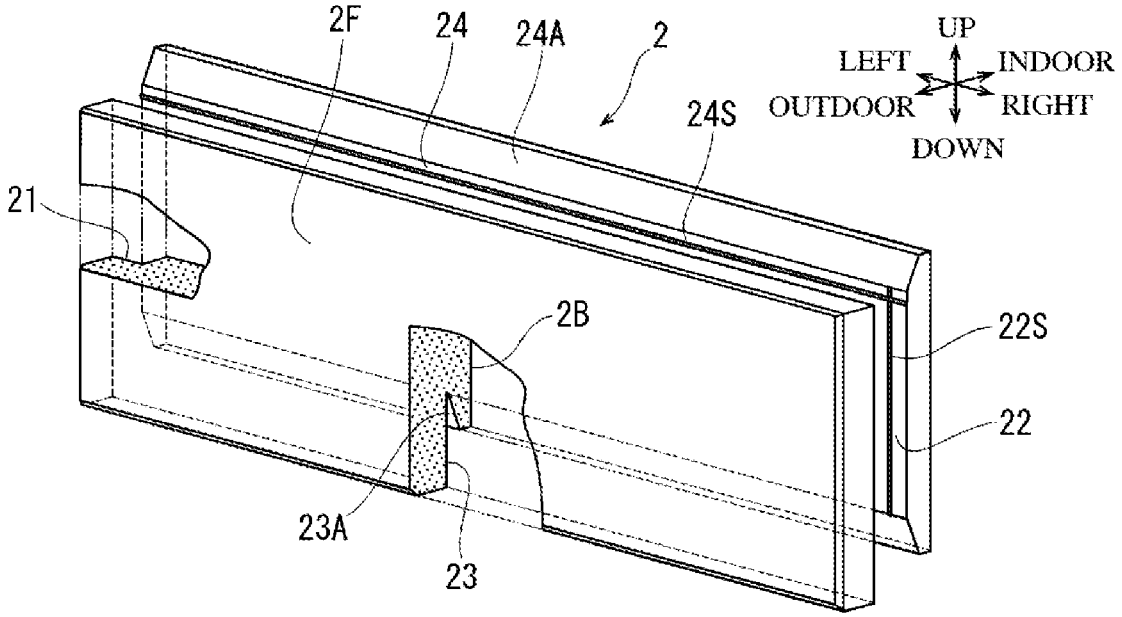
FIG. 2 is a perspective view of an exterior wall plate according to Embodiment 1.

As shown in FIG. 2, each exterior wall plate 2 is a plate material having a quadrihorizontal shape, more specifically, a horizontally elongated, substantially rectangular shape. In the present embodiment, the exterior wall plate 2 is made of a ceramic material including cement. Note that the material and the shape of the exterior wall plate 2 are not limited to those described above. For example, a metal material, a wood material, a resin material, or the like can be selected as appropriate as the material of the exterior wall plate 2. As for the shape of the exterior wall plate 2, a plate material having a quadrihorizontal shape, i.e., a vertically elongated, substantially rectangular shape can be selected as appropriate, for example.

A front surface 2F of the exterior wall plate 2 is, for example, an exterior surface provided with a design such as a brick pattern. A front horizontal joint portion 21 is formed at a left end portion of the exterior wall plate 2. A rear horizontal joint portion 22 is formed at a right end portion of the exterior wall plate 2. A front vertical joint portion 23 is formed at a lower end portion of the exterior wall plate 2. A rear vertical joint portion 24 is formed at an upper end portion of the exterior wall plate 2. Note that, in FIG. 2, the sizes of the front horizontal joint portion 21, the rear horizontal joint portion 22, the front vertical joint portion 23, and the rear vertical joint portion 24 are shown in an exaggerated manner, relative to the size of the exterior wall plate 2.

Figure 3:
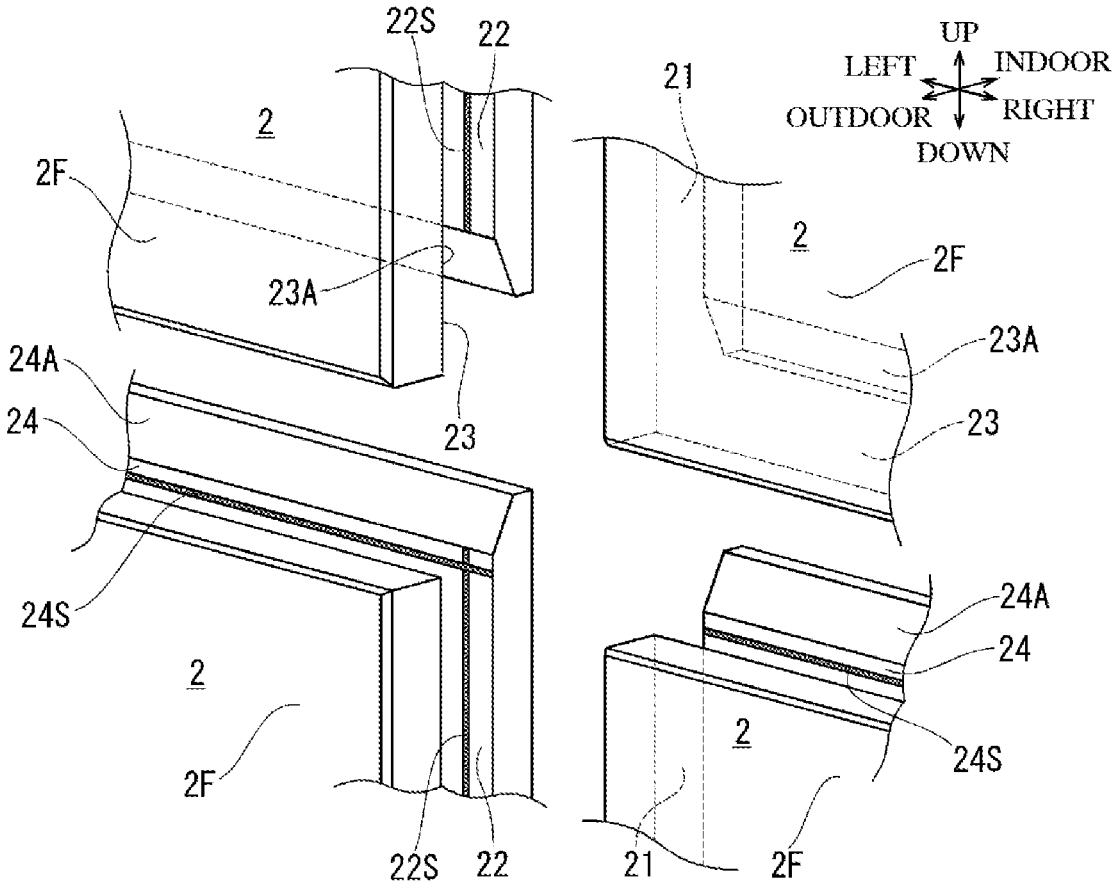
FIG. 3 is a partial perspective view showing a configuration for joining/attaching exterior wall plates to each other, according to Embodiment 1.

As shown in FIGS. 2 and 3, the front horizontal joint portion 21 is formed in the shape of a step from a back surface 2B toward the front surface 2F of the exterior wall plate 2, and extends in a vertical direction, that is, along the left end portion of the exterior wall plate 2.

The rear horizontal joint portion 22 is formed in the shape of a step from the front surface 2F toward the back surface 2B of the exterior wall plate 2, and extends in the vertical direction, that is, along the right end portion of the exterior wall plate 2. A caulking material 22S is provided on a flat surface of the rear horizontal joint portion 22 that faces in the outdoor direction. The caulking material 22S is provided in a line along the rear horizontal joint portion 22. Note that a caulking material is not essential, and the caulking material 22S may be omitted.

The front vertical joint portion 23 is formed in the shape of a step from the back surface 2B toward the front surface 2F of the exterior wall plate 2, and extends in a horizontal direction, that is, along the lower end portion of the exterior wall plate 2. An engagement recess 23A that is recessed upward in a substantially tapered shape is formed in the front vertical joint portion 23.

The rear vertical joint portion 24 is formed in the shape of a step from the front surface 2F toward the back surface 2B of the exterior wall plate 2, and extends in the horizontal direction, that is, along the upper end portion of the exterior wall plate 2. A caulking material 24S is provided on a flat surface of the rear vertical joint portion 24 that faces in the outdoor direction. The caulking material 24S is provided in a line along the rear vertical joint portion 24. Note that the caulking material is not essential, and the caulking material 24S may be omitted. An engagement protrusion 24A that protrudes upward in a substantially tapered shape, on the upper side of the caulking material 24S, is formed on the rear vertical joint portion 24.

Figure 4:
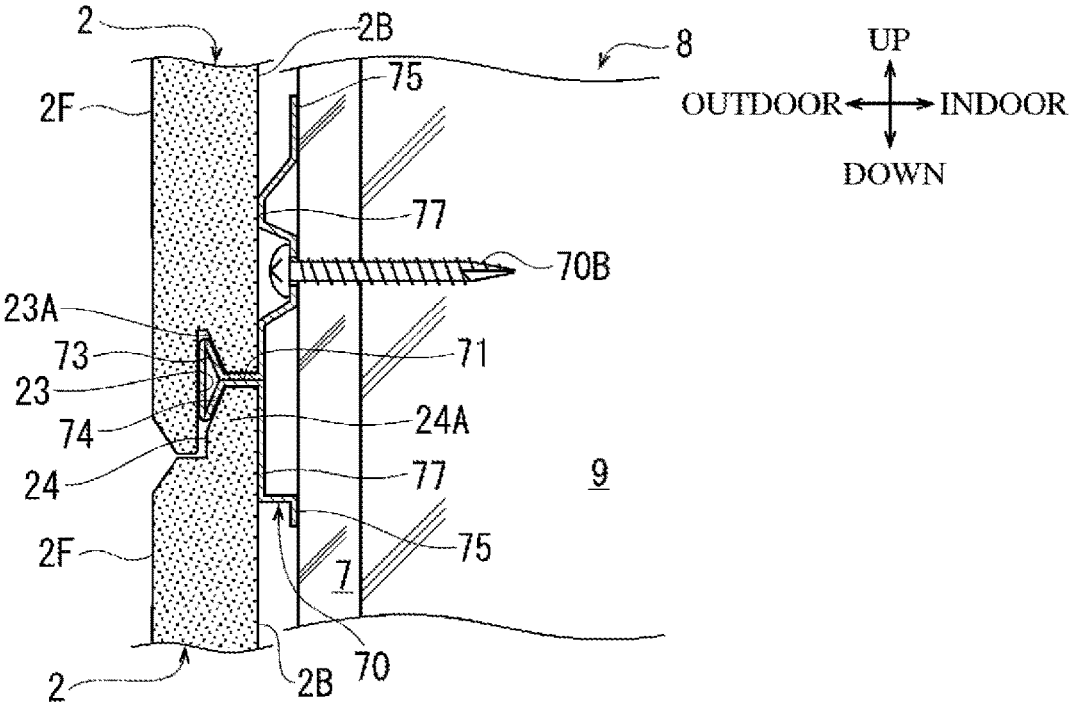
FIG. 4 is a partial cross-sectional view taken along IV-IV in FIG. 1, showing a vertical shiplap portion for two vertically aligned exterior wall plates, according to Embodiment 1.

As shown in FIG. 4, a horizontally extending vertical shiplap portion is formed between vertically adjacent exterior wall plates 2 as a result of the rear vertical joint portion 24 of the lower exterior wall plate 2 and the front vertical joint portion 23 of the upper exterior wall plate 2 overlapping each other. Although not shown, a horizontal shiplap portion is formed between horizontally adjacent exterior wall plates 2 as a result of the front horizontal joint portion 21 of the right exterior wall plate 2 and the rear horizontal joint portion 22 of the left exterior wall plate 2 overlapping each other. That is, each exterior wall plate 2 is a plate material having a so-called "four-way shiplap structure", including the front horizontal joint portion 21, the rear horizontal joint portion 22, the front vertical joint portion 23, and the rear vertical joint portion 24.

Each of the exterior wall plates 2 having such a structure is mounted to the structural body 8 in the following manner, using a starting mounting member 60 shown in FIG. 1, a shiplap-portion mounting member 70 shown in FIGS. 1 and 4, and a mounting member 100 of Embodiment 1 shown in FIGS. 5 to 11.

As shown in FIG. 1, a draining member 8G and a starting mounting member 60 are provided at a lower end portion of the outer surface of the structural body 8. The draining member 8G and the starting mounting member 60 have well-known configurations, and illustration thereof has been omitted. The starting mounting member 60 includes a flat-plate portion that is fixed to lower end portions of the column members 9, and a bent portion that is bent from a lower end of the flat-plate portion in the outdoor direction. The starting mounting member 60 is configured such that the bent portion thereof locks to the engagement recesses 23A of initially attached exterior wall plates 2, thus supporting lower end portions of the initially attached exterior wall plates 2 at a position above the draining member 8G.

As shown in FIGS. 1 and 4, a plurality of shiplap-portion mounting members 70 are provided on the outer surface of the structural body 8 so as to be vertically and horizontally spaced apart from each other. As shown in FIG. 4, each shiplap-portion mounting member 70 is configured to make a fixation portion 75 abut against a support member 7 at a position in the vicinity of a vertical shiplap portion of vertically adjacent exterior wall plates 2, and be fixed to the structural body 8 with a screw 70B serving as a fastening member.

An abutting portion 77 bulges in the outdoor direction so as to be spaced apart from the fixation portion 75. A supporting portion 71 protrudes in the outdoor direction from a substantially intermediate portion of the abutting portion 77 in the vertical direction, and also extends in the horizontal direction. An upper locking portion 73 protrudes upward from a distal end portion of the supporting portion 71. A lower locking portion 74 protrudes downward from the distal end portion of the supporting portion 71.

The lower locking portion 74 locks to the engagement protrusion 24A of the lower exterior wall plate. The upper locking portion 73 locks to the engagement recess 23A of the upper exterior wall plate. The supporting portion 71 supports a lower end portion of the upper exterior wall plate 2. The abutting portion 77 abuts against the back surfaces 2B of the upper and lower exterior wall plates 2, and secures a ventilation space between the structural body 8 and the back surfaces 2B of the exterior wall plates 2. Thus, the shiplap-portion mounting member 70 supports the vertical shiplap portion of vertically adjacent exterior wall plates 2.

By performing such an operation for the other exterior wall plates 2, the exterior wall plates 2 are supported by the structural body 8 so as to be adjacent to each other in the vertical direction and the horizontal direction, thus covering the outer surface of the structural body 8.

As shown in FIG. 1, the exterior wall plate 2 may be mounted in the vicinity of an opening, such as a window frame 8W, of the structural body 8. In this case, to avoid interference with the window frame 8W, a portion of the exterior wall plate 2 that includes the rear vertical joint portion 24 is cut, and then the exterior wall plate 2 is mounted to the structural body 8. An end portion formed by cutting the exterior wall plate 2 is disposed adjacent to the window frame 8W from below.

Although not shown, in the case of mounting the exterior wall plate 2 in the vicinity of a balcony, eaves, or the like of the structural body 8, a portion of the exterior wall plate 2 that includes the rear vertical joint portion 24 is cut in order to avoid interference with the balcony or the like, and then the exterior wall plate 2 is mounted to the structural body 8. An end portion formed by cutting the exterior wall plate 2 is disposed adjacent to the balcony or the like from below.

Here, each of these end portions formed by cutting the exterior wall plate 2 is referred to as a specific end portion 2P. As will be described below, the mounting member 100 according to Embodiment 1 shown in FIGS. 5 to 11 supports the specific end portion 2P of the exterior wall plate 2. Note that, in the following description, a configuration in which the specific end portion 2P is supported by the mounting member 100 so as to be disposed adjacent to the window frame 8W from below will be described. A configuration in which the specific end portion 2P is supported by the mounting member 100 so as to be disposed adjacent to a balcony, eaves, or the like is the same as the aforementioned configuration, and therefore a description thereof has been omitted. Depending on the shape of the window frame 8W, a balcony, eaves, or the like, the specific end portion 2P may be inclined.

Figure 5:
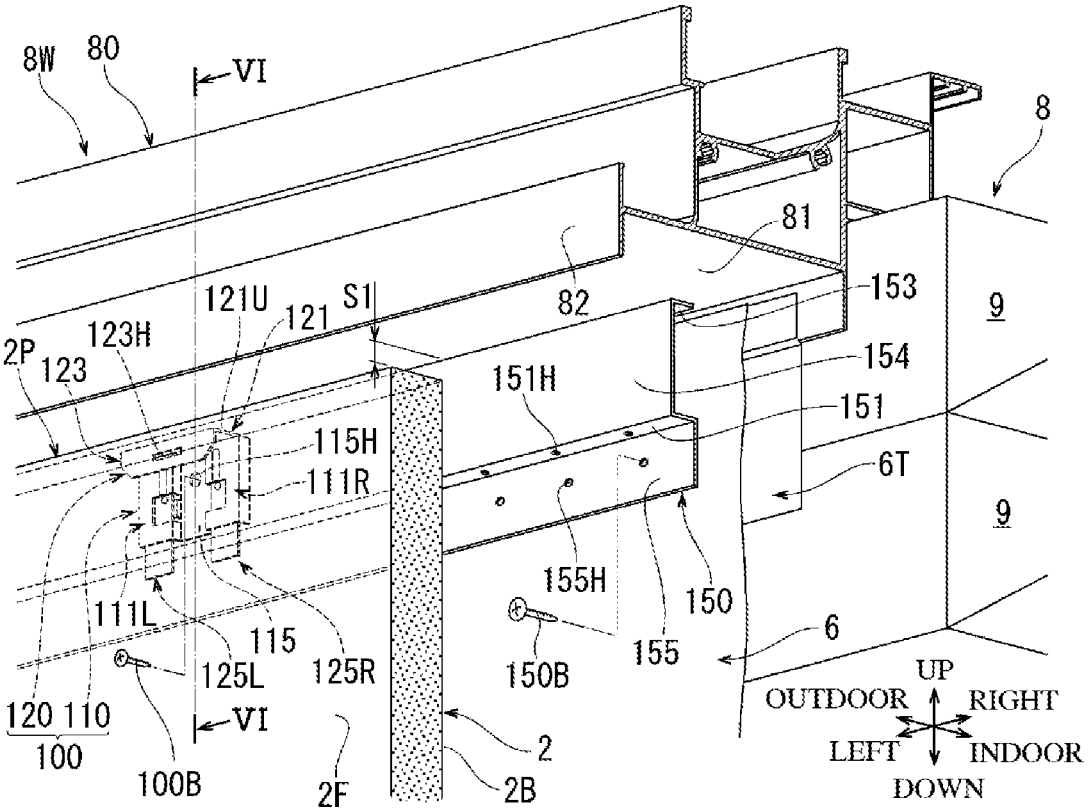
FIG. 5 is a partial perspective view showing a state in which an exterior wall plate disposed below a window frame is mounted to a structural body, according to Embodiment 1.
Figure 6:
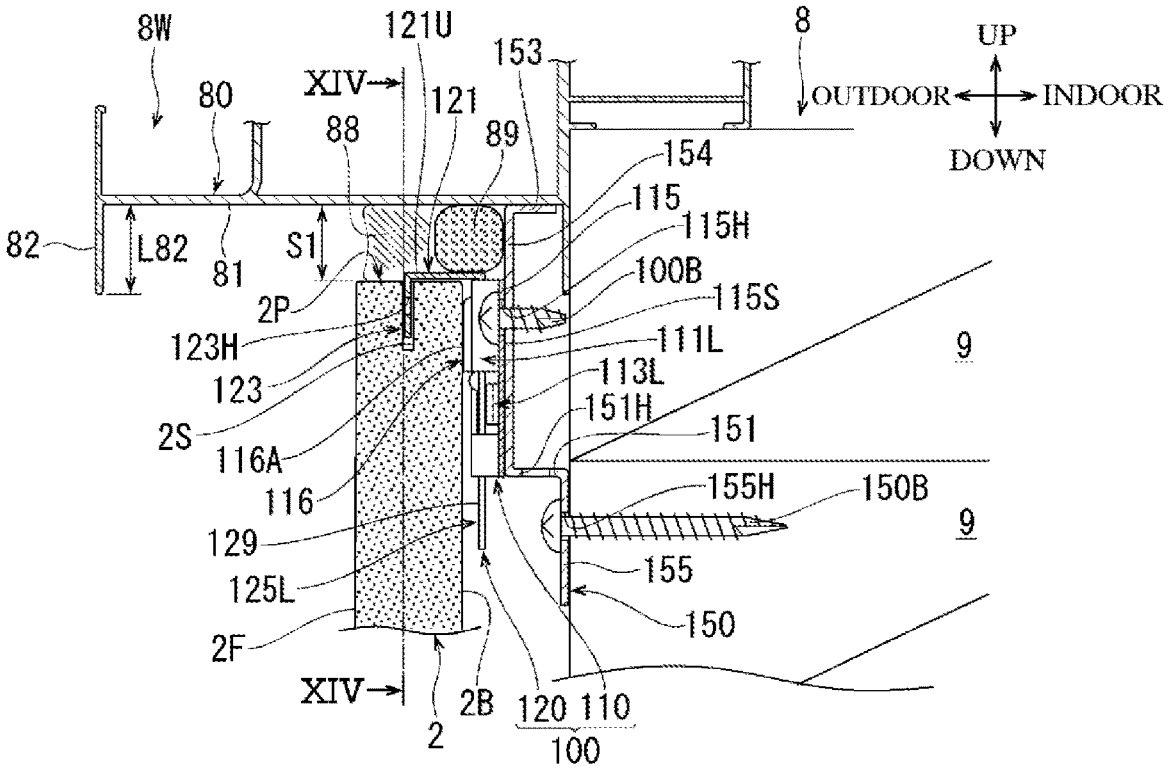
FIG. 6 is a partial cross-sectional view taken along VI-VI in FIG. 5.
Figure 7:
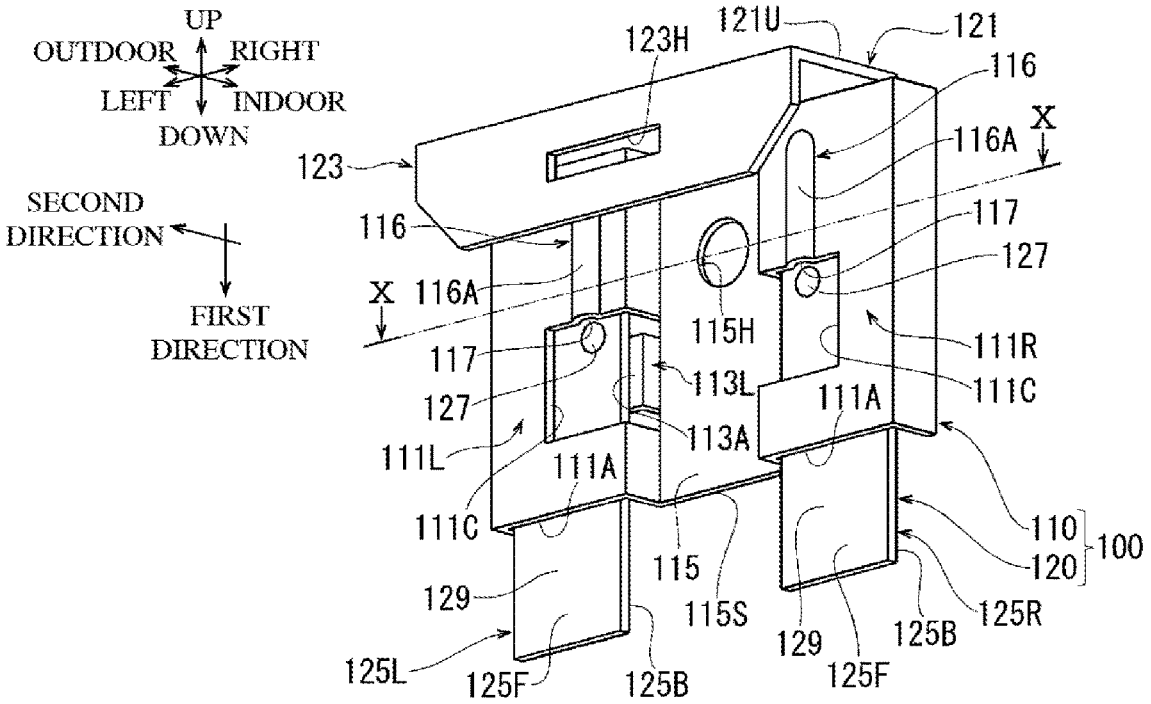
FIG. 7 is a perspective view showing a mounting member according to Embodiment 1.

In the example shown in FIGS. 5 and 6, the mounting member 100 is fixed to the structural body 8 via a base member 150 so as to be disposed adjacent, from below, to an aluminum sash 80 that forms the lower side of the window frame 8W, thus supporting the specific end portion 2P of the exterior wall plate 2. Note that, in the description of the shape and so forth of the mounting member 100, the vertical direction, the horizontal direction, and the indoor-outdoor direction are defined based on a state in which the mounting member 100 is mounted to the structural body 8. As shown in FIG. 7, the first direction is a downward direction in the present embodiment. The direction that is opposite to the first direction is the upward direction. The second direction that intersects the first direction is the outdoor direction.

The base member 150 is a shaped member elongated in the horizontal direction, and is used after having been appropriately cut to have a length corresponding to the installation location. The base member 150 includes a substrate portion 155, a support plate portion 154, a coupling portion 151, and a top surface portion 153.

The substrate portion 155 extends in a flat-plate shape. The substrate portion 155 is provided with a plurality of fixing holes 155H through which nails, screws, or the like serving as fastening members are inserted. The number and the interval of the fixing holes 155H can be set as appropriate according to the configuration or the like of the structural body 8.

Portions of the base member 150, excluding the substrate portion 155, namely, the coupling portion 151, the support plate portion 154, and the top surface portion 153 form a substantially cross-sectionally C-shaped portion. More specifically, the coupling portion 151 is connected to the upper edge of the substrate portion 155, extends so as to be bent in the outdoor direction and be spaced apart from the structural body 8, and also extends in the horizontal direction. The coupling portion 151 is provided with a plurality of through holes 151H extending therethrough in the vertical direction. The support plate portion 154 is connected, at its lower edge, to the distal edge of the coupling portion 151, and extends in a flat-plate shape, substantially parallel to the substrate portion 155. The top surface portion 153 is connected to the upper edge of the support plate portion 154, extends so as to approach the structural body 8, in the indoor direction, and also extends in the horizontal direction.

The base member 150 is fixed to the structural body 8 in the following manner. That is, the top surface portion 153 of the base member 150 is abutted against a bottom wall portion 81, which is the downward-facing surface of the sash 80, from below, or a slight gap is secured therebetween. Then, as shown in FIG. 5, in a state in which a waterproof sheet 6 and waterproof tape 6T are interposed between the substrate portion 155 and the structural body 8, an operation of screwing a screw 150B serving as a fastening member into a fixing hole 155H of the substrate portion 155 is performed at a plurality of locations, and, thus, the substrate portion 155 is firmly fixed to the structural body 8.

In a state in which the substrate portion 155 is fixed to the structural body 8, the support plate portion 154 is spaced apart from the structural body 8 in the outdoor direction. Thus, the space surrounded by the coupling portion 151, the support plate portion 154, and the top surface portion 153 allows ventilation to the outside through the through holes 151H.

As shown in FIGS. 7 to 11, the mounting member 100 includes a fixed member 110 and a movable member 120. In the present embodiment, the fixed member 110 and the movable member 120 are each produced by subjecting a single metal plate to punching, pressing, bending, or the like.

The fixed member 110 includes a vertically elongated, substantially rectangular base portion 115. The surface of the base portion 115 that faces in the indoor direction is set as a reference surface 115S extending in the vertical direction and the horizontal direction. The base portion 115 is provided with a fixing hole 115H extending therethrough. The base portion 115 can be fixed to the structural body 8 by screwing a fastening member such as a screw 100B or inserting a nail into the support plate portion 154 of the base member 150 via the fixing hole 115H in a state in which the reference surface 115S is brought into contact with the support plate portion 154 of the base member 150. Note that the base portion 115 can also be directly fixed to a column member 9 or the like.

The fixed member 110 includes guiding portions 111L and 111R and pressing portions 113L and 113R.

The left guiding portion 111L is a substantially cross-sectionally C-shaped portion that is connected to the left edge of the base portion 115. The right guiding portion 111R is a substantially cross-sectionally C-shaped portion that is connected to the right edge of the base portion 115. That is, the guiding portions 111L and 111R are a pair of plate-shaped pieces that are provided at positions sandwiching the base portion 115 in the horizontal direction, and that extend from the base portion 115. A substantially rectangular cut-out portion 111C is formed in an area of each of the guiding portions 111L and 111R that is adjacent to the base portion 115.

The left pressing portion 113L is formed by cutting and bending a portion of the guiding portion 111L that corresponds to the cut-out portion 111C, and constitutes a substantially cross-sectionally L-shaped portion extending from the left edge of the base portion 115 so as to be located in the cut-out portion 111C of the left guiding portion 111L. The right pressing portion 113R is formed by cutting and bending the above-described portion of the guiding portion 111R in the same manner, and constitutes a substantially cross-sectionally L-shaped portion extending from the right edge of the base portion 115 so as to be located inside the cut-out portion 111C of the right guiding portion 111R. That is, the pressing portions 113L and 113R are a pair of small pieces that are provided at positions sandwiching the base portion 115 in the horizontal direction, and that extend from the base portion 115 while opposing the guiding portions 111L and 111R.

The surface of each of the guiding portions 111L and 111R that faces in the indoor direction is a guiding surface 111A. The guiding surfaces 111A extend parallel to the reference surface 115S at a position spaced apart from the reference surface 115S in the outdoor direction.

The surface of each of the pressing portions 113L and 113R that faces in the outdoor direction is a pressing surface 113A. The pressing surfaces 113A extend parallel to the reference surface 115S at a position that is spaced apart from the reference surface 115S in the outdoor direction, and that is spaced apart from the corresponding guiding surface 111A in the indoor direction.

Each of the guiding portions 111L and 111R includes a linear projection portion 116. The linear projection portions 116 bulge in the outdoor direction from a surface of the guiding portions 111L and 111R that face in the outdoor direction, and extend in the vertical direction. The lower end of the linear projection portion 116 reaches the upper end of the corresponding cut-out portion 111C. The upper end of the linear projection portion 116 is located below the upper end of the corresponding guiding surface 111A.

A top surface of the linear projection portion 116 that faces in the outdoor direction serves as a support surface 116A. The support surface 116A extends in the vertical direction, parallel to the reference surface 115S.

A recess that is a groove portion extending in the vertical direction and recessed in the outdoor direction is formed in the back surface of the linear projection portion 116 that faces the side opposing the support surface 116A, and the recess serves as a restricting portion 117. In addition to serving as the support surface 116A and the restricting portion 117 in this manner, the linear projection portions 116 also serve as a rib for reinforcing the guiding portion 111L and 111R.

Next, the movable member 120 will be described. The movable member 120 includes a pair of leg portions 125L and 125R. The leg portions 125L and 125R are examples of the movable main body. The leg portions 125L and 125R are each a vertically elongated, substantially rectangular plate-shaped piece, and are spaced apart from each other in the horizontal direction.

Each of the leg portions 125L and 125R includes a first surface 125F and a second surface 125B. The first surface 125F is a surface of the leg portions 125L and 125R that faces in the outdoor direction. The second surface 125B is a surface of the leg portions 125L and 125R that faces in the indoor direction. A restricted portion 127 is provided protruding from a substantially intermediate portion of each of the leg portions 125L and 125R. The restricted portion 127 is a semi-spherical protrusion that bulges from the first surface 125F in the outdoor direction.

The movable member 120 includes a protruding piece 121 and a locking piece 123. The protruding piece 121 and the locking piece 123 are provided spanning the left leg portion 125L and the right leg portion 125R.

More specifically, the protruding piece 121 is a substantially rectangular plate-shaped piece extending in the indoor-outdoor direction and the horizontal direction. A left portion of the rear edge of the protruding piece 121 is connected to the upper end of the left leg portion 125L. A right portion of the rear edge of the protruding piece 121 is connected to the upper end of the right leg portion 125R. That is, the protruding piece 121 protrudes from the upper ends of the pair of leg portions 125L and 125R, in the outdoor direction.

The locking piece 123 is bent and protrudes downward from the distal edge of the protruding piece 121, and extends in the horizontal direction. The locking portion 123 is formed in a downwardly tapered shape as a result of a lower left corner portion and a lower right corner portion thereof having been cut off. Note that the lower edge of the locking portion 123 can also be formed in a downwardly bulging arc shape.

The leg portions 125L and 125R of the movable member 120 are guided by the guiding portions 111L and 111R of the fixed member 110 so as to be able to move in the vertical direction, and are pressed by the pressing portions 113L and 113R of the fixed member 110 toward the guiding portions 111L and 111R.

Figure 10:
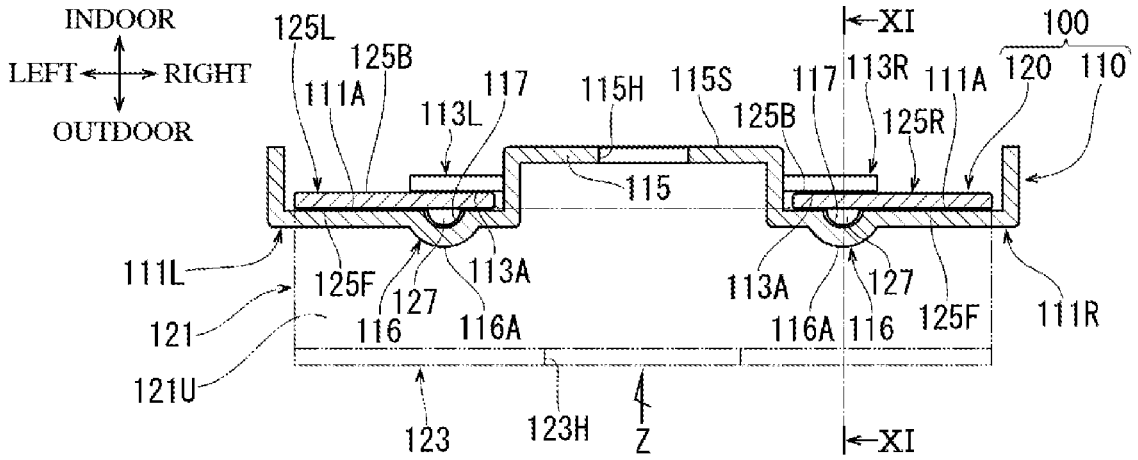
FIG. 10 is a cross-sectional view taken along X-X in FIG. 7.

More specifically, as shown in FIG. 10, the left leg portion 125L is disposed in the left guiding portion 111L. Also, the guiding surface 111A of the left guiding portion 111L is in surface contact with the first surface 125F of the left leg portion 125L. The pressing surface 113A of the left pressing portion 113 is in surface contact with the second surface 125B of the left leg portion 125L so as to press the left leg portion 125L toward the guiding surface 111A of the left guiding portion 111L. The restricted portion 127 of the left leg portion 125L is located inside the restricting portion 117 of the left guiding portion 111L.

Figure 11:
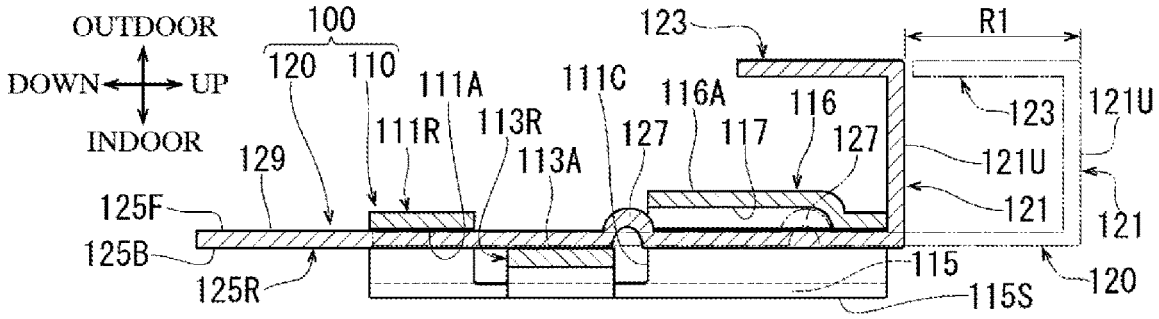
FIG. 11 is a cross-sectional view taken along XI-XI in FIG. 10.

As shown in FIGS. 10 and 11, the right leg portion 125R is disposed in the right guiding portion 111R. Also, the guiding surface 111A of the right guiding portion 111R is in surface contact with the first surface 125F of the right leg portion 125R. The pressing surface 113A of the right pressing portion 113 is in surface contact with the second surface 125B of the right leg portion 125R so as to press the right leg portion 125R toward the guiding surface 111A of the right guiding portion 111L. The restricted portion 127 of the right leg portion 125R is located inside the restricting portion 117 of the right guiding portion 111R.

Thus, each of the pair of leg portions 125L and 125R of the movable member 120 is sandwiched by the corresponding guiding surface 111A and the corresponding pressing surface 113A of the fixed member 110, and, through frictional engagement due to surface contact between these surfaces, the pair of leg portions 125L and 125R are supported by the fixed member 110 so as to be able to move in the vertical direction.

When the leg portions 125L and 125R move in the vertical direction by being guided by the guiding portions 111L and 111R, the restricted portions 127 of the movable member 120 slide in the respective corresponding restricting portions 117 of the fixed member 110. This suppresses inclining and lateral displacement of the movable member 120 relative to the fixed member 110.

As the movable member 120 is indicated by solid lines in FIG. 11, when the leg portions 125L and 125R move downward, the locking piece 123 is displaced to a close position at which the locking piece 123 is closest to the fixed member 110. The locking pieces 123 shown in FIGS. 5 to 7 are also at the close position.

Figure 8:
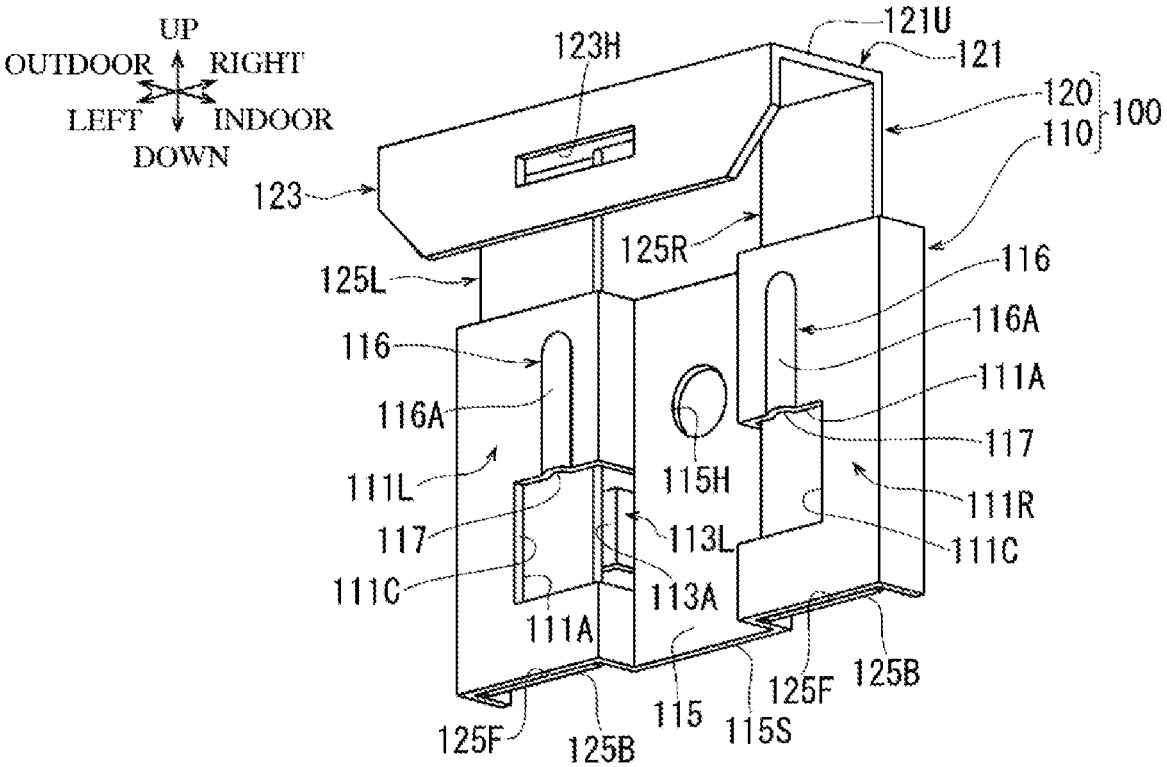
FIG. 8 is a perspective view showing the mounting member according to Embodiment 1.
Figure 12:
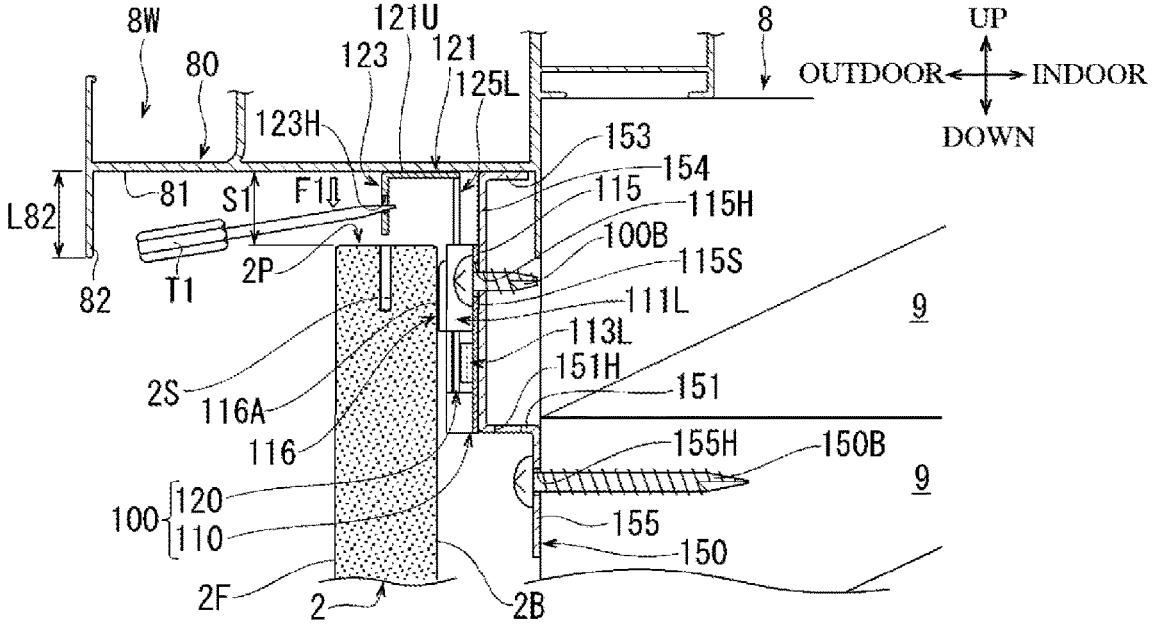
FIG. 12 is a partial cross-sectional view similar to FIG. 6, showing a state in which a locking piece is yet to lock a specific end portion of the exterior wall plate.

On the other hand, as the movable member 120 is indicated by dashed double-dotted lines in FIG. 11, when the leg portions 125L and 125R move upward, the locking piece 123 is displaced to a spaced position at which the locking piece 123 is spaced farthest apart from the fixed member 110. The locking piece 123 shown in FIGS. 8 and 12 are also at the spaced position.

Figure 13:
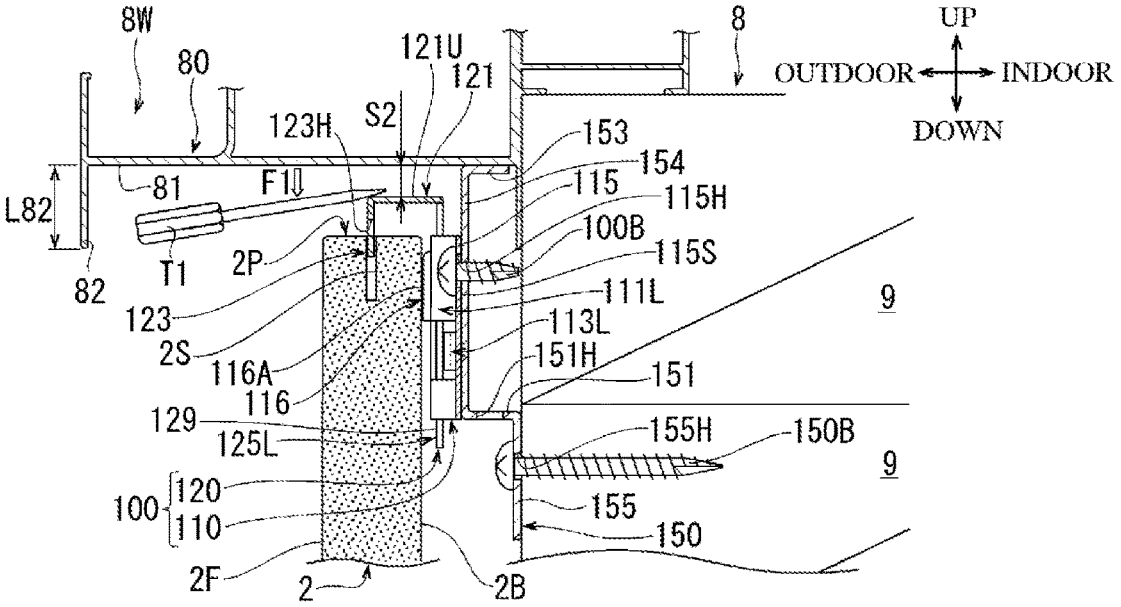
FIG. 13 is a partial cross-sectional view similar to FIG. 6, showing a state in which the locking piece has moved downward to start locking a specific end portion of the exterior wall plate.

The locking piece 123 shown in FIG. 13 is at a position between the close position and the spaced position. As shown in FIG. 11, the moving range of the movable member 120 when the locking piece 123 is displaced between the close position and the spaced position is denoted by R1.

As the movable member 120 is indicated by solid lines in FIG. 11, the lower limit of the moving range R1 of the movable member 120 is defined by the upper ends of the guiding portions 111L and 111R abutting against and restricting a basal portion of the protruding piece 121 of a downwardly moving movable member 120.

As the movable member 120 is indicated by dashed double-dotted lines in FIG. 11, the upper limit of the moving range R1 of the movable member 120 is defined by upper end portions of the restricting portions 117 abutting against and restricting the restricted portions 127 of an upwardly moving movable member 120.

Note that when the locking piece 123 is located between the close position and the spaced position, the locking piece 123 is held at that position through frictional engagement due to surface contact between the guiding surface 111A and the first surface 125F, and surface contact between the pressing surface 113A and the second surface 125B.

As shown in FIGS. 7 and 11, a lower end portion of the first surface 125F of each of the leg portions 125L and 125R serves as a marker portion 129. In a state in which the locking piece 123 is at the close position, the marker portion 129 is exposed from the guiding portion 111L or 111R of the fixed member 110. On the other hand, as shown in FIG. 8, in a state in which the locking piece 123 is at the spaced position, the marker portion 129 is covered by the guiding portion 111L or 111R of the fixed member 110, and is not exposed.

As shown in FIGS. 7 to 11, the protruding piece 121 is provided with a first tool engagement portion 121U. The first tool engagement portion 121U is the upper surface of the protruding piece 121.

A second tool engagement portion 123H is provided in an intermediate portion of the locking piece 123 in the vertical direction. The second tool engagement portion 123H is a horizontally elongated rectangular hole, and extends through the locking piece 123 in the indoor-outdoor direction. When the movable member 120 is viewed in the indoor-outdoor direction, i.e., viewed from the direction indicated by the arrow Z in FIG. 10, the second tool engagement portion 123H is provided in the locking piece 123 between the left leg portion 125L and the right leg portion 125R.

As shown in FIG. 13, the first tool engagement portion 121U is capable of taking on a downward force F1, for example, when a tool T1 having a flat tip, such as a flathead screwdriver, abuts against the first tool engagement portion 121U.

As shown in FIG. 12, the second tool engagement portion 123H is capable of taking on a downward force F1 at a position displaced downwardly relative to the first tool engagement portion 121U, i.e., the upper surface of the protruding piece 121, when the tool T1 is inserted into the second tool engagement portion 123H.

Operation and Effect

Next, an installation method for supporting a specific end portion 2P of the exterior wall plate 2 using a mounting member 100 having such a configuration will be described.

First, the exterior wall plate 2 is cut to have dimensions suited to the bottom wall portion 81 of the sash 80 described above. Consequently, a portion of the exterior wall plate 2 that includes the rear vertical joint portion 24 is cut off, and a specific end portion 2P is formed.

Figure 14:
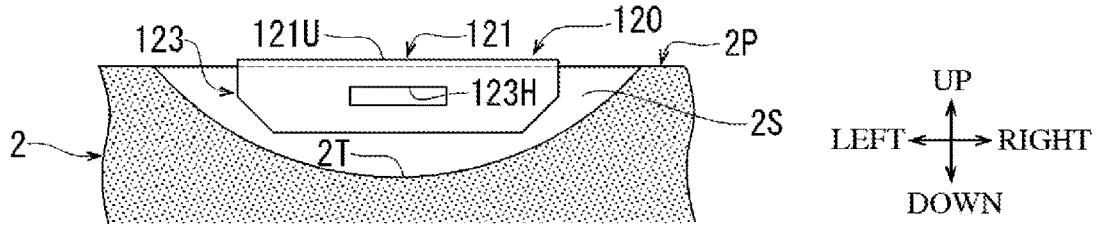
FIG. 14 is a cross-sectional view taken along XIV-XIV in FIG. 6.

Then, as shown in FIG. 14, a groove portion 2S is formed in the specific end portion 2P of the exterior wall plate 2 through grooving. More specifically, using an electric circular saw or the like that uses a motor to rotate a circular rotary blade, the groove portion 2S is cut in the specific end portion 2P of the exterior wall plate 2 using the rotary blade. Consequently, a bottom surface 2T of the groove portion 2S is recessed in an arc shape, and the groove portion 2S is deeper at its central part, and gradually becomes shallower toward its left and right ends. As shown in FIG. 6, the interval between the opposing inner sides of the groove portion 2S is set to be slightly larger than the plate thickness of the locking portion 123.

Next, as shown in FIG. 12, the mounting member 100 is mounted to the base member 150. At this time, the movable member 120 is in a state in which it is at the spaced position at which the locking piece 123 is spaced farthest apart from the fixed member 110. This state corresponds to each restricting portion 117 and the corresponding restricted portion 127 being positioned abutted against each other, and therefore an operator can easily confirm this state. Even if the position of the locking piece 123 is downwardly displaced during operation, whether or not the locking piece 123 is at an appropriate position can also be visually confirmed because the marker portion 129 protrudes downward. At a position corresponding to the groove portion 2S formed in the specific end portion 2P of the exterior wall plate 2, the mounting member 100 is positioned in a state in which the base portion 115 of the fixed member 110 is brought into contact with the support plate portion 154 of the base member 150. At this time, the first tool engagement portion 121U of the movable member 120, i.e., the upper surface of the protruding piece 121, is in a state in which it is abutted against the bottom wall portion 81 of the sash 80 from below, or a slight gap is present between the bottom wall portion 81 and itself. Then, the mounting member 100 is fixed to the structural body 8 by screwing a fastening member such as the screw 100B or by inserting a nail into the support plate portion 154 via the fixing hole 115H.

Next, once the front vertical joint portion 23 formed at the lower end portion of the exterior wall plate 2 is supported using the starting mounting member 60 shown in FIG. 1 or the shiplap-portion mounting member 70 shown in FIG. 4, the back surface 2B of the exterior wall plate 2 is abutted against the support surface 116A of the fixed member 110 of the mounting member 100, as shown in FIG. 12.

In this state, the locking portion 123 of the movable member 120 is at a position that opposes the groove portion 2S of the specific end portion 2P from above. The lower end of the locking portion 123 is spaced upward from the specific end portion 2P by about 1 to 3 mm. The distance by which the lower end of the locking portion 123 is spaced apart from the specific end portion 2P is merely an example, and the value of the distance may be smaller than the aforementioned value, and may be close to substantially 0 mm, as long as the back surface 2B of the specific end portion 2P of the exterior wall plate 2 can be abutted against the support surface 116A.

Next, the tool T1 such as a flathead screwdriver is inserted into the second tool engagement portion 123H, which is a rectangular hole, so as to press the lower edge of the rectangular hole downward. Consequently, the second tool engagement portion 123H takes on the downward force F1, and thus the locking portion 123 of the movable member 120 is moved downward. The second tool engagement portion 123H is provided at the center of the locking piece 123, and the pair of leg portions 125L and 125R are disposed on opposite sides of the second tool engagement portion 123H. Accordingly, the downward force F1 is transmitted uniformly to the leg portions 125L and 125R, and thus the movable member 120 can be moved smoothly. As a result, the lower end side of the locking portion 123 enters the groove portion 2S of the specific end portion 2P of the exterior wall plate 2 within a range where the second tool engagement portion 123H is exposed from the specific end portion 2P of the exterior wall plate 2.

Next, as shown in FIG. 13, the tool T1 is caused to abut against the first tool engagement portion 121U, i.e., the upper surface of the protruding piece 121, so as to press the upper surface downward. Consequently, the first tool engagement portion 121U takes on the downward force F1, and, thus, the locking portion 123 of the movable member 120 is moved further downward. As a result, as shown in FIG. 6, the protruding piece 121 abuts against the specific end portion 2P of the exterior wall plate 2, resulting in a state in which the entire locking portion 123 has entered the groove portion 2S of the specific end portion 2P of the exterior wall plate 2.

As shown in FIG. 14, in this state, the tapered locking portion 123 extends along the bottom surface 2T, which is recessed in an arch shape, of the groove portion 2S. Furthermore, as shown in FIG. 6, the locking portion 123 is sandwiched by the opposing inner sides of the groove portion 2S.

Thus, the mounting member 100 can successfully support the specific end portion 2P of the exterior wall plate 2 in a state in which the specific end portion 2P is disposed adjacent to the window frame 8W from below.

Thereafter, a backup member 89 made of a foamed resin or the like is inserted into the gap between the bottom wall portion 81 of the sash 80 and the specific end portion 2P of the exterior wall plate 2, and the gap is further filled with a sealing material 88. As described above, by using the mounting member 100, it is possible to reduce the distance between the specific end portion 2P of the exterior wall plate 2 and the window frame 8W. This enhances the appearance quality of an installed wall. Note that a concealment portion 82 extending further downward than the bottom wall portion 81 is usually formed on the distal end side of the sash 80. When a length L82 from the bottom wall portion 81 to the lower end of the concealment portion 82 is set to be longer than a gap S1 between the bottom wall portion 81 of the sash 80 and the specific end portion 2P of the exterior wall plate 2, the sealing material 88 is concealed by the concealment portion 82, and thus the aesthetic appearance of the area surrounding the sash 80 and the specific end portion 2P of the exterior wall plate 2 is further enhanced.

As described above, the mounting member 100 includes the first tool engagement portion 121U and the second tool engagement portion 123H, and thus moves the locking piece 123 in a plurality of steps. Accordingly, as shown in FIG. 12, it is not necessary to secure a gap for inserting the tool T1 or the like between the bottom wall portion 81 of the sash 80 and the protruding piece 121 of the movable member 120 in a state in which the movable member 120 is at its position where the locking piece 123 is yet to lock the specific end portion 2P of the exterior wall plate 2, i.e., at the spaced position at which the locking piece 123 is spaced farthest apart from the fixed member 110.

Therefore, with the mounting member 100 of the exterior wall plate 2 and the wall structure according to Embodiment 1, it is possible to reduce the gap S1 between the lower end of the window frame 8W or the like such as the bottom wall portion 81 of the sash 80, and the specific end portion 2P of the exterior wall plate 2, while also facilitating the mounting operation. Thus, it is possible to enhance the appearance quality of an installed wall.

As shown in FIG. 13 and so forth, in the mounting member 100, the first tool engagement portion 121U is formed by the upper surface of the protruding piece 121. Accordingly, it is easy to provide the protruding piece 121 with the first tool engagement portion 121U.

Furthermore, with the mounting member 100, the second tool engagement portion 123H is a hole extending through the locking piece 123 in the indoor-outdoor direction, as shown in FIG. 12 and so forth. Accordingly, it is easy to provide the locking piece 123 with the second tool engagement portion 123H without it being bulky. In addition, the tool T1 can be reliably engaged with the second tool engagement portion 123H by inserting the tool T1 such as a flathead screwdriver into the second tool engagement portion 123H. As a result, it is possible to make the mounting member 100 more compact, and further facilitate the mounting operation.

With the mounting member 100, as the movable member 120 is indicated by dashed double-dotted lines in FIG. 11, the distance by which the movable member 120 is spaced apart from the fixed member 110 can be kept constant by the upper end portions of the restricting portions 117 of the fixed member 110 abutting against the restricted portions 127 of the movable member 120. This makes it possible to prevent the mounting member 100 from being fixed to a lower portion of the window frame 8W or the like in a state in which the movable member 120 is distanced from the fixed member 110 more than necessary. That is, it is possible to prevent a situation where the gap between the lower portion of the window frame 8W or the like and the specific end portion 2P of the exterior wall plate 2 is increased as a result of the distance between the lower surface of the window frame 8W or the like and the mounting member 100 being increased.

Furthermore, with the mounting member 100, as shown in FIGS. 10, 11, and so forth, the restricting portions 117 are vertically extending recesses that are provided in the guiding portions 111L and 111R, and the restricted portions 127 are formed by protrusions that are provided on the pair of leg portions 125L and 125R. Accordingly, it is easy to form the restricting portions 117 and the restricted portions 127.

With the mounting member 100, as shown in FIGS. 10, 11, and so forth, the groove portion on the back surface of each linear projection portion 116 is used as the restricting portion 117, and, thus, the configuration of the restricting portion 117 can be made more compact. Since the linear projection portion 116 also functions as a rib for reinforcing the guiding portion 111L or 111R, the guiding portions 111L and 111R and the pressing portions 113L and 113R can suitably guide the movable member 120. As shown in FIG. 12 and so forth, the exterior wall plate 2 can be supported, using the linear projection portion 116 as the support surface 116A. When mounting the exterior wall plate 2, the exterior wall plate 2 can be guided using the support surface 116A such that the specific end portion 2P of the exterior wall plate 2 approaches the locking piece 123.

Furthermore, with the mounting member 100, as shown in FIGS. 7 and 11, the marker portions 129 are exposed from the guiding portions 111L and 111R of the fixed member 110 in a state in which the locking piece 123 is at the close position. On the other hand, as shown in FIG. 8, in a state in which the locking piece 123 is at the spaced position, the marker portions 129 are covered by the guiding portions 111L and 111R of the fixed member 110, and are not exposed. With such marker portions 129, whether or not the locking piece 123 is at an appropriate position at which it is raised to the uppermost end can be confirmed visually when mounting the exterior wall plate 2, and it is therefore possible to further facilitate the mounting operation.

With the mounting member 100, each of the pair of leg portions 125L and 125R is sandwiched by the corresponding guiding surface 111A and the corresponding pressing surface 113A of the fixed member 110, and, through frictional engagement due to surface contact between these surfaces, the pair of leg portions 125L and 125R are supported by the fixed member 110 so as to be movable in the vertical direction. With this configuration, it is possible to simplify the mounting member 100. Through frictional engagement, it is possible to easily move the pair of leg portions 125L and 125R by engaging the tool T1 with the first tool engagement portion 121U and the second tool engagement portion 123H. As a result, it is possible to further facilitate the mounting operation.

Figure 9:
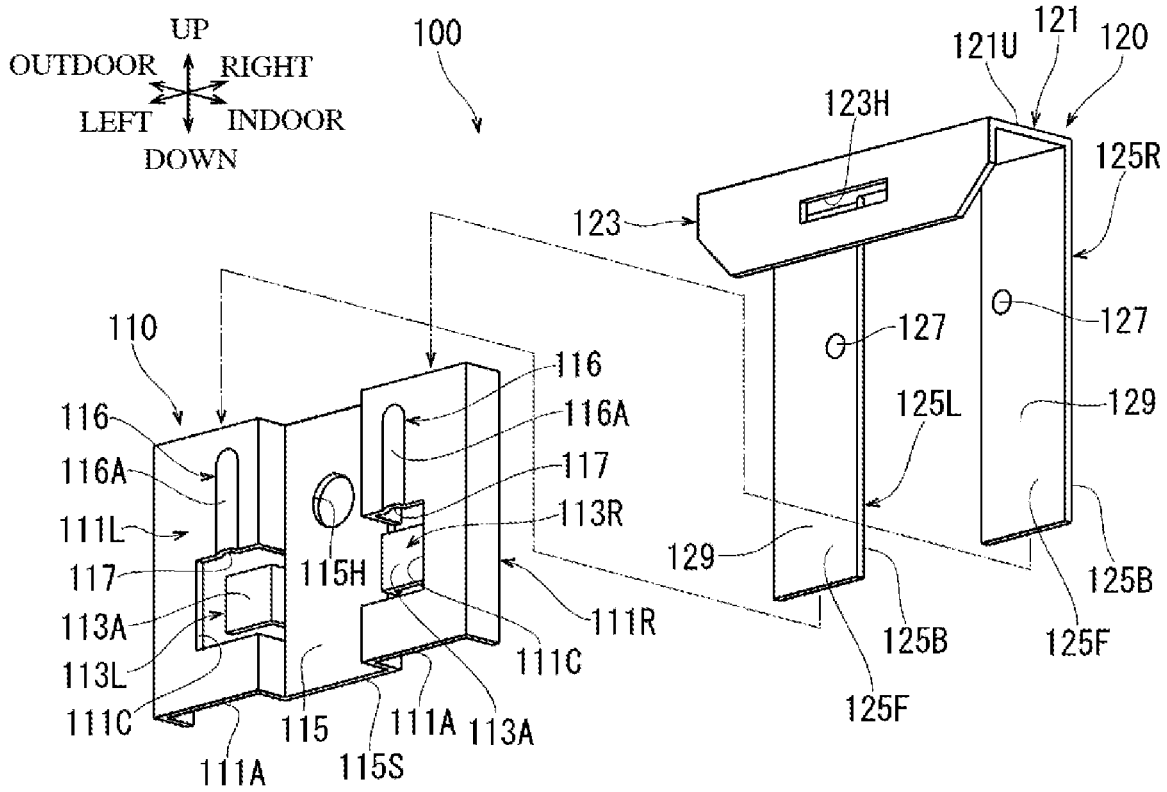
FIG. 9 is a perspective view showing a fixed member and a movable member separate from each other, according to Embodiment 1.

Furthermore, with the mounting member 100, as shown in FIG. 9 and so forth, for example, by bending, or cutting and bending a single metal plate that forms the fixed member 110, it is possible to easily form the guiding portions 111L and 111R and the pressing portions 113L and 113R, and also to easily form the guiding surface 111A, which is one surface of the guiding portion 111L or 111R, and the pressing surface 113A, which is one surface of the pressing portion 113L or 113R. By appropriately selecting the shape, size, bending angle, and the like of the pressing portions 113L and 113R, it is possible to easily adjust the magnitude of the sliding resistance generated by frictional engagement.

With the mounting member 100, the pair of leg portions 125L and 125R serving as the movable main body are disposed on the pair of guiding portions 111L and 111R, respectively. Then, as shown in FIG. 10, when the movable member 120 is viewed in the indoor-outdoor direction, the second tool engagement portion 123H is provided in the locking piece 123 between the left leg portion 125L and the right leg portion 125R. With such a simple configuration, the downward force F1 is transmitted uniformly to the left leg portion 125L and the right leg portion 125R when moving the movable member 120. As a result, it is possible to keep the movable member 120 from inclining relative to the guiding portions 111L and 111R, thus preventing the movable member 120 from catching on the guiding portions 111L and 111R while moving. As a result, it is possible to further facilitate the mounting operation.

Embodiment 2

Figure 15:
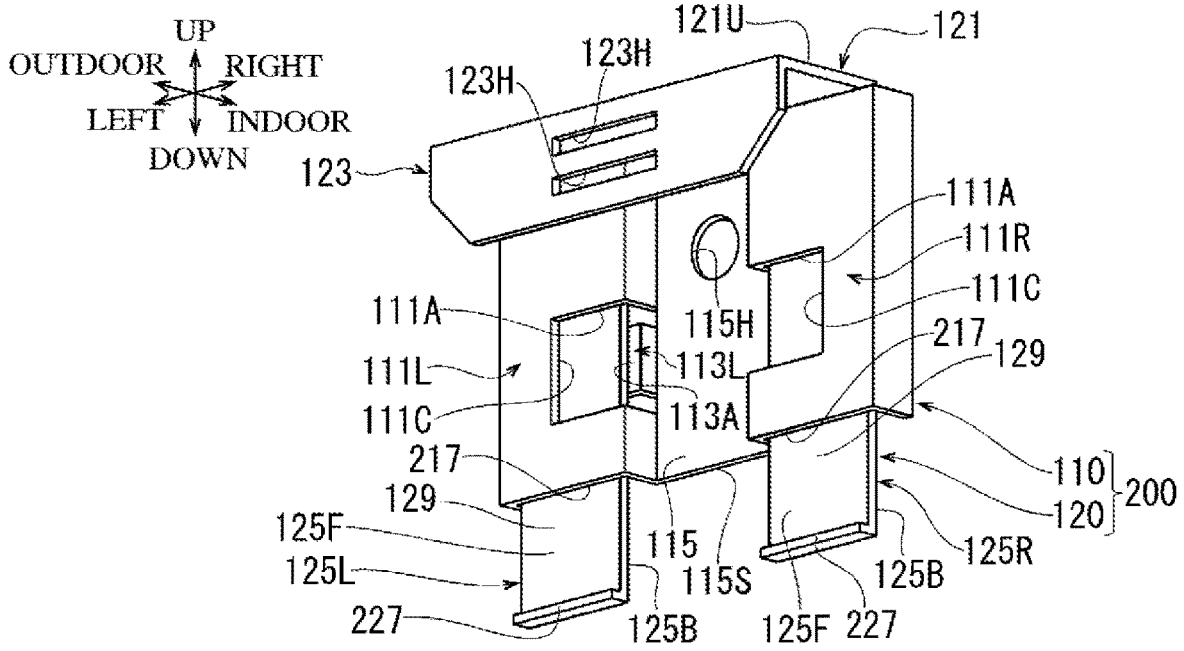
FIG. 15 is a perspective view showing a mounting member according to Embodiment 2.

As shown in FIG. 15, with a mounting member 200 according to Embodiment 2, two second tool engagement portions 123H are provided in the locking piece 123 of the movable member 120 so as to be vertically arranged. Restricting portions 217 are provided on a lower end portion of the fixed member 110, and restricted portions 227 are provided at a lower end portion of the movable member 120. Therefore, the fixed member 110 does not include the linear projection portions 116 and the restricting portions 117, and the movable member 120 does not include the restricted portions 127. The top surface of each of the linear projection portions 116 is used as the support surface 116A in Embodiment 1. Instead, the surface of each of the guiding portions 111L and 111R that faces in the outdoor direction is directly used as the support surface. The rest of the configuration of Embodiment 2 is the same as that of Embodiment 1. Therefore, the same components as those of Embodiment 1 are denoted by the same reference numerals, and the illustration and description thereof has been omitted.

The restricting portions 217 are the lower ends of the guiding portions 111L and 111R. The restricted portions 227 are small pieces that are bent from the respective lower ends of the leg portions 125L and 125R, and that protrude with a short length in the outdoor direction. The distal end of each of the restricted portions 227 is at a position displaced relative to the support surface 116A in the indoor direction, and is configured to not come into contact with the back surface 2B of the exterior wall plate 2 that is to be supported.

In a state in which the locking piece 123 is at the close position, each restricting portion 217 and the corresponding restricted portion 227 are spaced farthest apart from each other. Although not shown, in a state in which the movable member 120 is at the spaced position at which the locking piece 123 is spaced farthest apart from the fixed member 110, each restricting portion 217 of the fixed member 110 abuts against the corresponding restricted portion 227 of the movable member 120.

Also with the mounting member 200 of Embodiment 2 having such a configuration, it is possible to reduce the gap S1 between the lower end of the window frame 8W or the like, specifically, the bottom wall portion 81 of the sash 80, and the specific end portion 2P of the exterior wall plate 2, while also facilitating the mounting operation, as in the case of the mounting member 100 of Embodiment 1.

With the mounting member 200, it is possible to insert the tool T1 into the lower second tool engagement portion 123H so as to move the locking piece 123 downward, then, insert the tool T1 into the upper second tool engagement portion 123H so as to move the locking piece 123 downward, and finally abut the tool T1 against the first tool engagement portion 121U so as to move the locking piece 123 downward. As a result, it is possible to further reduce the gap S1 between the lower end of the window frame 8W or the like, specifically, the bottom wall portion 81 of the sash 80, and the specific end portion 2P of the exterior wall plate 2.

Although the present invention has been described above by way of Embodiments 1 and 2, the present invention is by no means limited to Embodiments 1 and 2 described above. Needless to say, modifications may be made as appropriate without departing from the scope and spirit of the invention.

For example, the first tool engagement portion need not be the upper surface of the protruding piece 121, and it is also possible to separately provide a hole, a groove, a projection, or the like in the protruding piece. The second tool engagement portion need not be a hole, and may be a groove or a projection, for example. It is also possible to provide a plurality of first tool engagement portions and second tool engagement portions.

The guiding portion and the pressing portion are not limited to a configuration in which the movable member is held through frictional engagement. It is also possible to adopt a configuration in which a projection is provided on the movable member, a hole is formed at a predetermined position of the guiding portion, and the guiding portion and the pressing portion hold the movable member at a position at which the projection enters the hole.

The marker portion may be covered by the fixed member in a state in which the locking piece is at the close position, and may be exposed from the fixed member in a state in which the locking piece is at the spaced position.

In the above-described embodiments, the guiding portion and the pressing portion are formed of a single plate material, and are configured in one piece. However, the fixed member may be formed of two plate materials including a first plate material and a second plate material. That is, it is possible to adopt a configuration in which the first plate material forms the base portion and the guiding portion, the second plate material forms the pressing portion by being joined to the first plate material in a state in which it opposes the guiding portion, and the movable main body of the movable member is sandwiched by the guiding portion of the first plate material and the pressing portion of the second plate material.

In Embodiment 1, in addition to functioning as the restricting portion 117 and the support surface 116A, each linear projection portion 116 also functions as a rib for reinforcing the guiding portion 111L or 111R. However, these functions may be achieved using separate members. For example, ribs for reinforcing the guiding portions 111L and 111R may be provided separately. Alternatively, as in the case of Embodiment 2, the surfaces of the guiding portions 111L and 111R that face in the outdoor direction may be directly used as support surfaces that support the back surface 2B of the exterior wall plate 2, without forming the support surfaces 116A as the linear projection portions.

LIST OF REFERENCE NUMERALS

8 Structural body
2 Wall material (exterior wall plate)
100 Mounting member
115 Base portion
110 Fixed member
125L, 125R Movable main body (pair of leg portions)
120 Movable member
111L, 111R Guiding portion
113L, 113R Pressing portion
121 Protruding piece
123 Locking piece
F1 Force in first direction
121U First tool engagement portion
123H Second tool engagement portion
117, 217 Restricting portion
127, 227 Restricted portion
R1 Moving range of movable member
116 Linear projection portion
129 Marker portion
125F First surface of movable main body
125B Second surface of movable main body
111A Guiding surface
113A Pressing surface
2P End portion of wall material (specific end portion)

The invention claimed is:

1. A wall-material mounting member for mounting a wall material to a structural body, comprising:

a fixed member including a base portion that can be fixed to the structural body; and a movable member including a movable main body configured to be movably supported by the fixed member, wherein the fixed member includes a guiding portion for movably guiding the movable main body in a first direction and accommodating the movable main body, and a pressing portion for pressing the movable main body toward the guiding portion, and the guiding portion and the pressing portion are configured so that the movable main body is supported between the guiding portion and the pressing portion, wherein the movable member includes a protruding piece protruding from the movable main body in a second direction that intersects the first direction, and a locking piece protruding from the protruding piece in the first direction, and capable of locking an end portion of the wall material, wherein the protruding piece of the movable member is provided with a first tool engagement portion capable of taking on a force in the first direction, the locking piece of the movable member is provided with a second tool engagement portion capable of taking on a force in the first direction, at a position that is displaced relative to the first tool engagement portion in the first direction, and the fixed member and the movable member are configured such that i) the movable member is slidably moved toward the fixed member along the guiding portion in the first direction by applying a force to the second tool engagement portion and further applying a force to the first tool engagement portion in the first direction, and ii) the movable main body is supported between the guiding portion and the pressing portion, and the locking piece locks the end of portion of the wall material.

2. The wall-material mounting member according to claim 1, wherein the first tool engagement portion is formed by a surface of the protruding piece that faces in a direction opposite to the first direction.

3. The wall-material mounting member according to claim 1, wherein the second tool engagement portion of the locking piece is a hole extending through the locking piece in the second direction, so that the movable member is slidably moved toward the fixed member along the guiding portion in the first direction by applying a force to the hole.

4. The wall-material mounting member according to claim 1, wherein the fixed member includes a restricting portion, the movable member includes a restricted portion, and the restricting portion is configured to abut against the restricted portion of the movable member moving in a direction opposite to the first direction so as to restrict a moving range of the movable member.

5. The wall-material mounting member according to claim 1, wherein the movable main body includes a marker portion that is covered by the fixed member in a state in which the locking piece is at one of a close position at which the locking piece is closest to the fixed member and a spaced position at which the locking piece is spaced farthest apart from the fixed member, and that is exposed from the fixed member in a state in which the locking piece is at the other of the close position and the spaced position.

6. The wall-material mounting member according to claim 1, wherein a pair of the guiding portions are provided at positions sandwiching the base portion, the movable main body includes a pair of leg portions respectively disposed in the pair of the guiding portions, the protruding piece and the locking piece are provided spanning the pair of the leg portions, and, when the movable member is viewed in the second direction, the second tool engagement portion is provided in the locking piece between one of the leg portions and the other leg portion.

7. The wall-material mounting member according to claim 1, wherein the second tool engagement portion of the locking piece is at least one of a hole, a groove, and a projection, so that the movable member is slidably moved toward the fixed member along the guiding portion in the first direction by applying a force to the second tool engagement portion.

8. A wall-material mounting member for mounting a wall material to a structural body, comprising:

a fixed member including a base portion that can be fixed to the structural body; and a movable member including a movable main body configured to be movably supported by the fixed member, wherein the fixed member includes a guiding portion for movably guiding the movable main body in a first direction and accommodating the movable main body, and a pressing portion for pressing the movable main body toward the guiding portion, and the guiding portion and the pressing portion are configured so that the movable main body is supported between the guiding portion and the pressing portion, wherein the movable member includes a protruding piece protruding from the movable main body in a second direction that intersects the first direction, and a locking piece protruding from the protruding piece in the first direction, and capable of locking an end portion of the wall material, wherein the protruding piece of the movable member is provided with a first tool engagement portion capable of taking on a force in the first direction, and the locking piece of the movable member is provided with a second tool engagement portion capable of taking on a force in the first direction at a position that is displaced relative to the first tool engagement portion in the first direction, wherein the fixed member includes a restricting portion, the movable member includes a restricted portion, and the restricting portion is configured to abut against the restricted portion of the movable member moving in a direction opposite to the first direction so as to restrict a moving range of the movable member, wherein the restricting portion is a recess that is provided in the guiding portion or the pressing portion, and that extends in the first direction, and the restricted portion is a protrusion that is provided protruding from the movable main body, and that is located inside the recess.

9. The wall-material mounting member according to claim 8, wherein the guiding portion or the pressing portion includes a linear projection portion extending in the first direction, the recess is formed by a groove portion formed along a back surface of the linear projection portion that opposes the movable main body, and the protrusion is located inside the groove portion.

10. A wall-material mounting member for mounting a wall material to a structural body, comprising:

a fixed member including a base portion that can be fixed to the structural body; and a movable member including a movable main body configured to be movably supported by the fixed member, wherein the fixed member includes a guiding portion for movably guiding the movable main body in a first direction and accommodating the movable main body, and a pressing portion for pressing the movable main body toward the guiding portion, and the guiding portion and the pressing portion are configured so that the movable main body is supported between the guiding portion and the pressing portion, wherein the movable member includes a protruding piece protruding from the movable main body in a second direction that intersects the first direction, and a locking piece protruding from the protruding piece in the first direction, and capable of locking an end portion of the wall material, wherein the protruding piece of the movable member is provided with a first tool engagement portion capable of taking on a force in the first direction, and the locking piece of the movable member is provided with a second tool engagement portion capable of taking on a force in the first direction at a position that is displaced relative to the first tool engagement portion in the first direction, wherein the movable main body includes a first surface facing in the second direction, and a second surface facing in a direction opposite to the second direction, the guiding portion includes a guiding surface that comes into surface contact with one of the first surface and the second surface, the pressing portion includes a pressing surface that comes into surface contact with the other of the first surface and the second surface, and the movable member is sandwiched by the guiding surface and the pressing surface.

11. The wall-material mounting member according to claim 10, wherein the guiding surface is one surface of a plate-shaped piece extending from the base portion, and the pressing surface is one surface of a small piece extending from the base portion, and opposes the guiding portion.

12. A wall structure in which a wall material is mounted to a structural body of a building by a mounting member, wherein the mounting member includes:

a fixed member including a base portion that can be fixed to the structural body; and a movable member including a movable main body configured to be movably supported by the fixed member, wherein the fixed member includes a guiding portion for movably guiding the movable main body in a first direction and accommodating the main movable body and a pressing portion for pressing the movable main body toward the guiding portion, and the guide portion and the pressing portion are configured so that the movable main body is supported between the guiding portion and the pressing portion, the movable member includes a protruding piece protruding from the movable main body in a second direction that intersects the first direction, and a locking piece protruding from the protruding piece in the first direction, and capable of locking an end portion of the wall material, the protruding piece of the movable member is provided with a first tool engagement portion capable of taking on a force in the first direction, the locking piece of the movable member is provided with a second tool engagement portion capable of taking on a force in the first direction at a position that is displaced relative to the first tool engagement portion in the first direction, and the fixed member and the movable member are configured such that i) the movable member is slidably moved toward the fixed member along the guiding portion in the first direction by applying a force to the second tool engagement portion and further applying a force to the first tool engagement portion in the first direction, and ii) the movable main body is supported between the guiding portion and the pressing portion, and the locking piece locks the end of portion of the wall material.

13. The wall structure according to claim 12, wherein the second tool engagement portion of the locking piece is at least one of a hole, a groove, and a projection, so that the movable member is slidably moved toward the fixed member along the guiding portion in the first direction by applying a force to the second tool engagement portion.

* * * * *